US010152008B2

(12) United States Patent
Yoshida et al.

(10) Patent No.: US 10,152,008 B2
(45) **Date of Patent: *Dec. 11, 2018**

(54) IMAGE FORMING APPARATUS

(71) Applicant: FUJI XEROX CO., LTD., Tokyo (JP)

(72) Inventors: Kana Yoshida, Kanagawa (JP); Masataka Kuribayashi, Kanagawa (JP); Masahiro Uchida, Kanagawa (JP); Takafumi Koide, Kanagawa (JP); Yusuke Fukuda, Kanagawa (JP); Katsuyuki Kitajima, Kanagawa (JP); Koji Funaba, Kanagawa (JP); Satomi Hara, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/892,942

(22) Filed: Feb. 9, 2018

(65) Prior Publication Data

US 2018/0275574 A1 Sep. 27, 2018

(30) Foreign Application Priority Data

Mar. 24, 2017 (JP) ..... 2017-059532

(51) Int. Cl.

| | |
|---|---|
| ***G03G 15/20*** | (2006.01) |
| ***G03G 9/08*** | (2006.01) |
| ***G03G 9/087*** | (2006.01) |

(52) U.S. Cl.

CPC ..... *G03G 15/2089* (2013.01); *G03G 9/081* (2013.01); *G03G 9/0819* (2013.01); *G03G 9/0827* (2013.01); *G03G 9/08755* (2013.01); *G03G 15/2017* (2013.01); *G03G 2215/2009* (2013.01); *G03G 2215/2016* (2013.01)

(58) Field of Classification Search

CPC ..... G03G 15/2017; G03G 2215/2016

See application file for complete search history.

(56) References Cited

U.S. PATENT DOCUMENTS

| | | | | |
|---|---|---|---|---|
| 6,013,406 A * | 1/2000 | Moriki | G03G 9/0821 | 430/108.22 |
| 9,098,039 B1 * | 8/2015 | Uehara | G03G 15/2064 | |
| 2014/0255839 A1 * | 9/2014 | Taguchi | G03G 9/09733 | 430/105 |

FOREIGN PATENT DOCUMENTS

JP 2014-056126 A 3/2014

* cited by examiner

*Primary Examiner* — Ryan D Walsh

(74) *Attorney, Agent, or Firm* — Sughrue Mion, PLLC

(57) ABSTRACT

An image forming apparatus includes an image holding member, a charging unit, an electrostatic charge image forming unit, a developing unit, a transfer unit, a fixing unit including a fixing belt, a pressurizing rotator that forms a nip by pressurizing an outer peripheral surface of the fixing belt, a sliding member that slides on an inner peripheral surface of the fixing belt in the nip, and a pressing member that presses the fixing belt in the direction of the pressurizing rotator, wherein a toner to be used includes a binder resin containing an amorphous resin and a crystalline resin and has specific physical properties described in the specification, and paraffin wax having a melting temperature of 60° C. to 80° C., and an absolute value of a difference between the melting temperature of the crystalline resin and the melting temperature of the paraffin wax is 10° C. or less.

10 Claims, 4 Drawing Sheets

IMAGE FORMING APPARATUS

CROSS-REFERENCE TO RELATED APPLICATIONS

This application is based on and claims priority under 35 USC 119 from Japanese Patent Application No. 2017-059532 filed Mar. 24, 2017.

BACKGROUND

1. Technical Field

The present invention relates to an image forming apparatus.

2. Related Art

Image formation according to an electrophotographic method is performed as follows. For example, a surface of an image holding member is charged, then an electrostatic charge image is formed on the surface of the image holding member in accordance with image information, subsequently, the electrostatic charge image is developed with a developer including a toner to form a toner image, and lastly the toner image is transferred and fixed to a surface of a recording medium.

SUMMARY

According to an aspect of the invention, there is provided an image forming apparatus including:

an image holding member;

a charging unit that charges a surface of the image holding member;

an electrostatic charge image forming unit that forms an electrostatic charge image on a charged surface of the image holding member;

a developing unit that includes an electrostatic charge image developer containing an electrostatic charge image developing toner, and develops the electrostatic charge image on the surface of the image holding member to form a toner image;

a transfer unit that transfers the toner image to a recording medium; and a fixing unit that fixes the toner image onto the recording medium, wherein the fixing unit includes:

a fixing belt;

a pressurizing rotator that forms a nip by pressurizing an outer peripheral surface of the fixing belt;

a sliding member that slides on an inner peripheral surface of the fixing belt in the nip in a contact manner, and a pressing member that presses the fixing belt in the direction of the pressurizing rotator, and wherein the electrostatic charge image developing toner includes:

a binder resin containing an amorphous resin and a crystalline resin; and paraffin wax, wherein the toner has a volume average particle diameter of 6 μm to 9 μm, a shape factor SF1 of 140 or more, and a toluene-insoluble portion of 25% by weight to 45% by weight;

the paraffin wax has a melting temperature of 60° C. to 80° C.; and an absolute value of a difference between a melting temperature of the crystalline resin and a melting temperature of the paraffin wax is 10° C. or less.

BRIEF DESCRIPTION OF THE DRAWINGS

Exemplary embodiments of the present invention will be described in detail based on the following figures, wherein.

DETAILED DESCRIPTION

Figure 1:
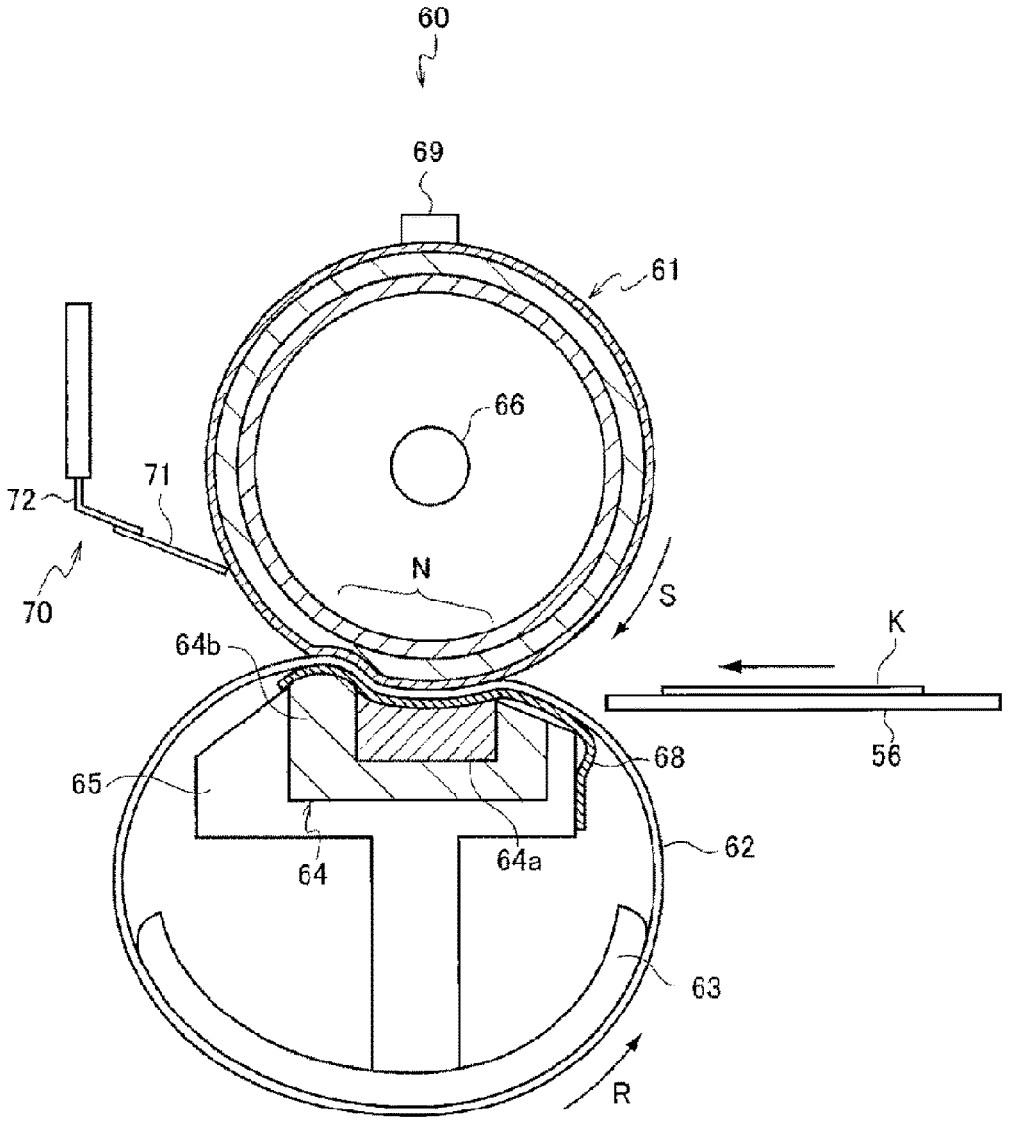
FIG. 1 is a configuration diagram illustrating an example of a fixing device in an exemplary embodiment.

Hereinafter, the exemplary embodiment which is an example of the invention will be described in detail.

Image Forming Apparatus

An image forming apparatus according to the exemplary embodiment is provided with an image holding member, a charging unit that charges a surface of the image holding member, an electrostatic charge image forming unit that forms an electrostatic charge image on the charged surface of the image holding member, a developing unit that accommodates an electrostatic charge image developer including an electrostatic charge image developing toner (hereinafter, simply referred to as "toner"), and develops the electrostatic charge image formed on the surface of the image holding member as a toner image with the electrostatic charge image developer, a transfer unit that transfers the toner image formed on the surface of the image holding member to a surface of a recording medium, and a fixing unit that fixes the transferred toner image onto the surface of the recording medium.

In addition, the fixing unit includes a fixing belt, a pressurizing rotator that forms a nip by pressurizing the outer peripheral surface of the fixing belt, and a pressing member that presses the fixing belt in the direction of the pressurizing rotator, and the fixing unit nips a recording medium having an unfixed toner image formed on the surface thereof between the nips, and then fixes the toner image transferred to the surface of the recording medium.

Further, the toner includes toner particles containing a binder resin which contains an amorphous resin and a crystalline resin, and paraffin wax having a melting temperature of 60° C. to 80° C., and in the toner, the absolute value of a difference between the melting temperature of the crystalline resin and the melting temperature of the paraffin wax is 10° C. or less, the volume average particle diameter of the toner particles is from 6 μm to 9 μm, a shape factor SF1 of the toner particles is 140 or more, and a toluene-insoluble portion of the toner is from 25% by weight to 45% by weight.

In the toner, the case where the toluene-insoluble portion is from 25% by weight to 45% by weight means that the toner contains an appropriate content of a crosslinked resin. That is, the toluene-insoluble portion means an index of the content of the crosslinked resin.

In addition, in the toner particles, the case where the shape factor SF1 is 140 or more means that the shape of the toner particle is irregular. Note that, the irregular toner particles having the shape factor SF1 of 140 or more typically mean pulverized toner particles prepared according to a pulverization method (for example, a kneading and pulverizing method).

In addition, in the toner particles, the case where the volume average particle diameter is from 6 μm to 9 μm means that the toner particles have a relatively small diameter.

Hereinafter, the toner having the above-described features in the exemplary embodiment may be referred to as a "specific pulverized toner", or simply referred to as a "toner".

In the electrophotographic image forming apparatus, the electrostatic charge image formed on the surface of the image holding member is developed with the developer including a toner so as to form a toner image, the toner image is transferred to the surface of the recording medium from the image holding member, and then the toner image is fixed onto the recording medium so as to from an image on the recording medium.

In addition, toner particles (pulverized toner particles) prepared according to the pulverization method may be used in the electrophotographic image forming apparatus, and from the viewpoint of the low temperature fixability or the like, examples of the pulverized toner particles include toner particles in which the crystalline resin is used as the binder resin, and the paraffin wax having a melting temperature of 60° C. to 80° C. (hereinafter, also simply referred to as "specific paraffin wax") is used as wax.

However, in a case of using the pulverized toner particles including the crystalline resin and the specific paraffin wax, the fixability of the toner image with respect to the recording medium may be deteriorated.

The reason for that is presumed as follows.

The pulverized toner particles are generally prepared by mixing the binder resin, the coloring agent, wax, and the like with each other, and then pulverizing the mixture. Due to this preparing method, the shape of the toner particle is likely to be irregular, and the pulverized cross-section becomes the surface of the toner particle, and thereby it is likely that the surface of the toner particle is exposed to the crystalline resin and the specific paraffin wax. Here, the toner particles are prepared according to a pulverizing method, and thus the degree of exposure (the ratio of the exposed area on the particle surface) of the crystalline resin and the specific paraffin wax for each individual pulverized toner particle tends to vary. The crystalline resin and wax are relatively easy to melt as compared with other components in the pulverized toner particles; however, the degree of the exposure of the crystalline resin which is likely to be melted and the wax is different for each individual pulverized toner particle, and thus when heat is applied for fixing, a melting method is likely to be different for each pulverized toner particles. That is, variation in melting between toners is likely to occur. As a result, toner particles which are likely to be melted and firmly fixed, and toner particles which are less likely to be melted and thus hard to enhance the fixing strength are present together in the toner image, and thereby the fixability of the entire toner images is likely to be deteriorated.

In contrast, in the image forming apparatus according to exemplary embodiment, the fixing unit includes the fixing belt, the pressurizing rotator that forms a nip by pressurizing the outer peripheral surface of the fixing belt, and the pressing member that presses the fixing belt in the direction of the pressurizing rotator, and the fixing unit nips a recording medium having an unfixed toner image formed on the surface thereof between the nips, and then fixes the toner image transferred to the surface of the recording medium. With such a configuration, it is possible to obtain high fixability.

The reason for that is presumed as follows.

With a configuration in which a pressurizing rotator and a pressing member face each other via the fixing belt, for example, a nip having a long width may be formed as compared with a fixing member (so-called a two-roller type fixing member) in which two rollers face each other and contact each other with a nip formed therebetween. With this, since the heating time for the recording medium passing through nip is increased and the total heat given to the unfixed toner image may be increased, it is possible to melt pulverized toner particles having relatively low degree of exposure (the ratio of the exposed area on the particle surface) of the crystalline resin and the specific paraffin wax in the toner image. That is, the toner particles which are less likely to be melted and thus hard to enhance the fixing strength are heated so as to be melted, and thereby the fixability of the entire toner image is enhanced.

Further, in the exemplary embodiment, it is possible to obtain high fixability even when the electrostatic charge image developing toner includes the toner particles in which the absolute value of a difference between the melting temperatures of the crystalline resin and the specific paraffin wax is 10° C. or less.

The reason for that is presumed as follows.

In the components in the toner particles, an SP value becomes smaller (hydrophobicity is increased) in order of the amorphous resin, the crystalline resin, and the release agent. For this reason, in the toner particles, the crystalline resin is likely to be in the periphery of a release agent domain (an aggregate of the release agent). In addition, in the exemplary embodiment, the difference in the melting temperatures between the release agent (the specific paraffin wax) and the crystalline resin is within the above range, and thus when the toner image is heated in the fixing unit, timing at which the release agent (the specific paraffin wax) is melted and timing at which the crystalline resin is melted are close to each other. In other words, the specific paraffin wax and the crystalline resin present in the periphery of the domain are melted at close timing, compatibility between the crystalline resin and the specific paraffin wax is improved, and the diffusibility of the crystalline resin is also enhanced by the influence of the specific paraffin wax melted from the toner particles. As a result, it is considered that the fixability of the toner image is improved by diffusing the crystalline resin well.

With such a configuration, it is possible to obtain high fixability of the toner image according to the exemplary embodiment.

Nip Width

In the fixing unit of the exemplary embodiment, the nip formed in a contact area between the fixing belt and the pressurizing rotator has a width (length of the contact area of the fixing belt in the circumferential direction (that is, driving direction)) which is preferably 6 mm or more, is further preferably 6.5 mm or more, and is still further preferably 7 mm or more.

When the nip width is within the above range, the heating time for the recording medium passing through nip is increased, and the fixability is likely to be enhanced.

On the other hand, the upper limit of the nip width is 10 mm or less, is further preferably 9.5 mm or less, and is still further preferably 9 mm or less from the viewpoint of prevention of image defects due to peeling failure.

Transport Speed

A transport speed (that is, a process speed) of the recording medium is preferably from 90 mm/sec to 380 mm/sec, is further preferably from 120 mm/sec to 350 mm/sec, and is still further preferably from 140 mm/sec to 330 mm/sec.

When the transport speed is 380 mm/sec or less, a passing speed at which the recording medium passes through the nip becomes gentle and the heating time for the recording medium becomes long, which makes it easier to enhance the fixability. On the other hand, when the transport speed is 90 mm/sec or more, a forming speed at which an image is formed is increased.

Subsequently, a configuration of the image forming apparatus according to exemplary embodiment will be described.

The image forming apparatus according to the exemplary embodiment is provided with an image holding member, a charging unit that charges a surface of the image holding member, an electrostatic charge image forming unit that forms an electrostatic charge image on the charged surface of the image holding member, a developing unit that accommodates an electrostatic charge image developer including an electrostatic charge image developing toner, and develops the electrostatic charge image formed on the surface of the image holding member as a toner image with the electrostatic charge image developer, a transfer unit that transfers the toner image formed on the surface of the image holding member to a surface of a recording medium, and a fixing unit that fixes the toner image onto the surface of the recording medium.

In addition, the fixing unit includes the fixing belt, the pressurizing rotator, and the pressing member. In addition, as the electrostatic charge image developing toner, the specific pulverized toner is used.

Here, in order to describe the configuration of the image forming apparatus according to exemplary embodiment, first, the fixing unit will be described in detail.

Fixing Unit

The fixing unit in the exemplary embodiment includes the fixing belt, the pressurizing rotator that forms a nip by pressurizing the outer peripheral surface of the fixing belt, and the pressing member that presses the fixing belt in the direction of the pressurizing rotator. In addition, the fixing unit nips a recording medium having an unfixed toner image formed on the surface thereof between the nips, and then fixes the toner image transferred to the surface of the recording medium.

Note that, in the fixing unit of the exemplary embodiment, the recording medium (a recording medium having an unfixed toner image) passing through the nip may be heated by the fixing belt, or the pressurizing rotator. In other words, (1) an exemplary embodiment of the fixing unit having a configuration in which the heating unit that heats the pressurizing rotator is provided, and the heating is performed when the heated pressurizing rotator contacts the surface of the recording medium on which an unfixed toner image is formed may be employed, or (2) an exemplary embodiment of the fixing unit having a configuration in which the heating unit that heats the fixing belt is provided, and the heating is performed when the heated fixing belt contacts the surface of the recording medium on which an unfixed toner image is formed may be employed. In the case of the exemplary embodiment (1), the fixing belt is provided as a pressurizing and fixing belt, and the pressurizing rotator is provided as a heating and pressurizing member, and in the case of the exemplary embodiment (2), the fixing belt is provided as a heating and fixing belt, and the pressurizing rotator is provided as a pressurizing member.

In addition, examples of the pressurizing rotator include a roll-shaped rotator and a belt-shaped rotator.

In addition, in the fixing unit, the pressing member may be a member directly contacting the inner peripheral surface of the fixing belt, or the pressing member may be a member contacting the inner peripheral surface of the fixing belt via a sliding member.

Configuration of Fixing Unit (Fixing Device)

Hereinafter, as an example of the fixing unit (a fixing device), an exemplary embodiment (first exemplary embodiment) in which the fixing unit is provided with the heating roller and the pressurizing and fixing belt (the fixing belt), and an exemplary embodiment (second exemplary embodiment) in which the fixing unit is provided with the heating and fixing belt (the fixing belt) and the pressurizing roller will be described.

Note that, the fixing unit is not limited to the first and second exemplary embodiments, and may be a fixing device provided with a heating and fixing belt and a pressurizing and fixing belt.

In addition, the fixing unit is not limited to the first and second exemplary embodiments, and may be an electromagnetic induction heating type fixing device.

First Exemplary Embodiment of Fixing Unit

The fixing unit (fixing device) according to the first exemplary embodiment will be described. FIG. 1 is a schematic diagram illustrating an example of a fixing device in the first exemplary embodiment.

As illustrated in FIG. 1, the fixing device 60 according to the first exemplary embodiment is configured to include a heating roller 61 (an example of the pressurizing rotator) that rotates, a pressurizing and fixing belt 62 (an example of the fixing belt), and a pressing pad 64 (an example of the pressing member) that presses the heating roller 61 via the pressurizing and fixing belt 62. In addition, a sheet-shaped low friction member 68 (an example of the sliding member) is provided between the inner peripheral surface of the pressurizing and fixing belt 62 and the pressing pad 64.

Note that, in the pressing pad 64, the pressurizing and fixing belt 62 and the heating roller 61 may be relatively pressurized. Accordingly, the pressurizing and fixing belt 62 side may be pressurized by the heating roller 61, or the heating roller 61 side may be pressurized by the pressurizing and fixing belt 62.

The heating roller 61 is provided with a halogen lamp 66 (an example of the heating unit) therein. The heating unit is not limited to the halogen lamp, and for example, another heat generating member that generates heat may be used.

On the other hand, a temperature sensitive element 69 is disposed to contact the surface of the heating roller 61. Based on a temperature measured value obtained by this temperature sensitive element 69, the halogen lamp 66 is controlled to be turned on, and a target setting temperature (for example, 150° C.) of the surface of the heating roller 61 is maintained.

The pressurizing and fixing belt 62 is rotatably supported by, for example, the pressing pad 64 disposed inside the belt and the belt running guide 63. In addition, in a nip area (nip) N, the pressurizing and fixing belt 62 is disposed to be pressed by the pressing pad 64 with respect to the heating roller 61.

The pressing pad 64 is disposed inside the pressurizing and fixing belt 62 in a state of being pressurized by the heating roller 61 via the pressurizing and fixing belt 62, and has the nip N formed between the pressing pad 64 and the heating roller 61.

In the pressing pad 64, for example, a front nipping member 64*a* for securing the wide nip N is disposed on the inlet side of the nip N, and a peeling nipping member 64*b* for imparting strain to the heating roller 61 is disposed on the outlet side of the nip N.

In order to reduce the sliding resistance (friction) between the inner peripheral surface of the pressurizing and fixing belt 62 and the pressing pad 64, the sheet-shaped low friction member 68 is provided on a surface of the front nipping member 64*a* and the peeling nipping member 64*b*, which contacts the pressurizing and fixing belt 62. In addition, the pressing pad 64 and the low friction member 68 are held by a metallic holding member 65.

Note that, the low friction member 68 is provided such that the sliding surface thereof contacts the inner peripheral surface of the pressurizing and fixing belt 62, and relates to holding and supplying of the lubricating oil present between the pressurizing and fixing belt 62.

In the fixing device as illustrated in FIG. 1, the low friction member 68 constitutes the sliding member that slides on the inner peripheral surface of the pressurizing and fixing belt 62; however, the sliding member may not be provided with the low friction member 68. That is, the pressing pad 64 which is the pressing member may be a member that slides directly contacting the inner surface of the pressurizing and fixing belt 62.

A belt running guide 63 is attached to the holding member 65, and the pressurizing and fixing belt 62 rotates.

The heating roller 61 rotates in the direction of an arrow S by, for example, by a driving motor (not shown), and following this rotation, the pressurizing and fixing belt 62 rotates in the direction of an arrow R which is opposite to the rotation direction of the heating roller 61. In other words, for example, the heating roller 61 rotates in the clockwise direction in FIG. 1; whereas, the pressurizing and fixing belt 62 rotates in the counterclockwise direction.

Further, paper K (an example of the recording medium) having an unfixed toner image is guided by, for example, a fixation entrance guide 56, and is transported to the nip area (nip) N. In addition, when the paper K passes through the nip area (nip) N, the toner image on the paper K is fixed to the nip area (nip) N by pressure and heat.

In a fixing device 60 according to the first exemplary embodiment, for example, a wide nip N is ensured by the front nipping member 64*a* having a recessed shape following the outer peripheral surface of the heating roller 61, as compared with a configuration in which the front nipping member 64*a* is not provided.

In addition, in the fixing device 60 according to the first exemplary embodiment, for example, with the peeling nipping member 64*b* which is disposed to be projected to the outer peripheral surface of the heating roller 61, the strain of the heating roller 61 is locally increased in an outlet area of the nip N.

When the peeling nipping member 64*b* is disposed as described above, for example, the paper K after fixing is supposed to pass through the locally formed large strain at the time of passing through the nip area (nip) N, and thus the paper K is likely to peel from the heating roller 61.

As an auxiliary unit for peeling, for example, a peeling member 70 is disposed on the downstream side of the nip N of the heating roller 61. The peeling member 70 is held by, for example, a holding member 72 in a state where a peeling claw 71 closely contacts the heating roller 61 in the direction (counter direction) facing the rotation direction of the heating roller 61.

Second Exemplary Embodiment of Fixing Device

Next, the fixing unit (fixing device) according to the second exemplary embodiment will be described.

Figure 2:
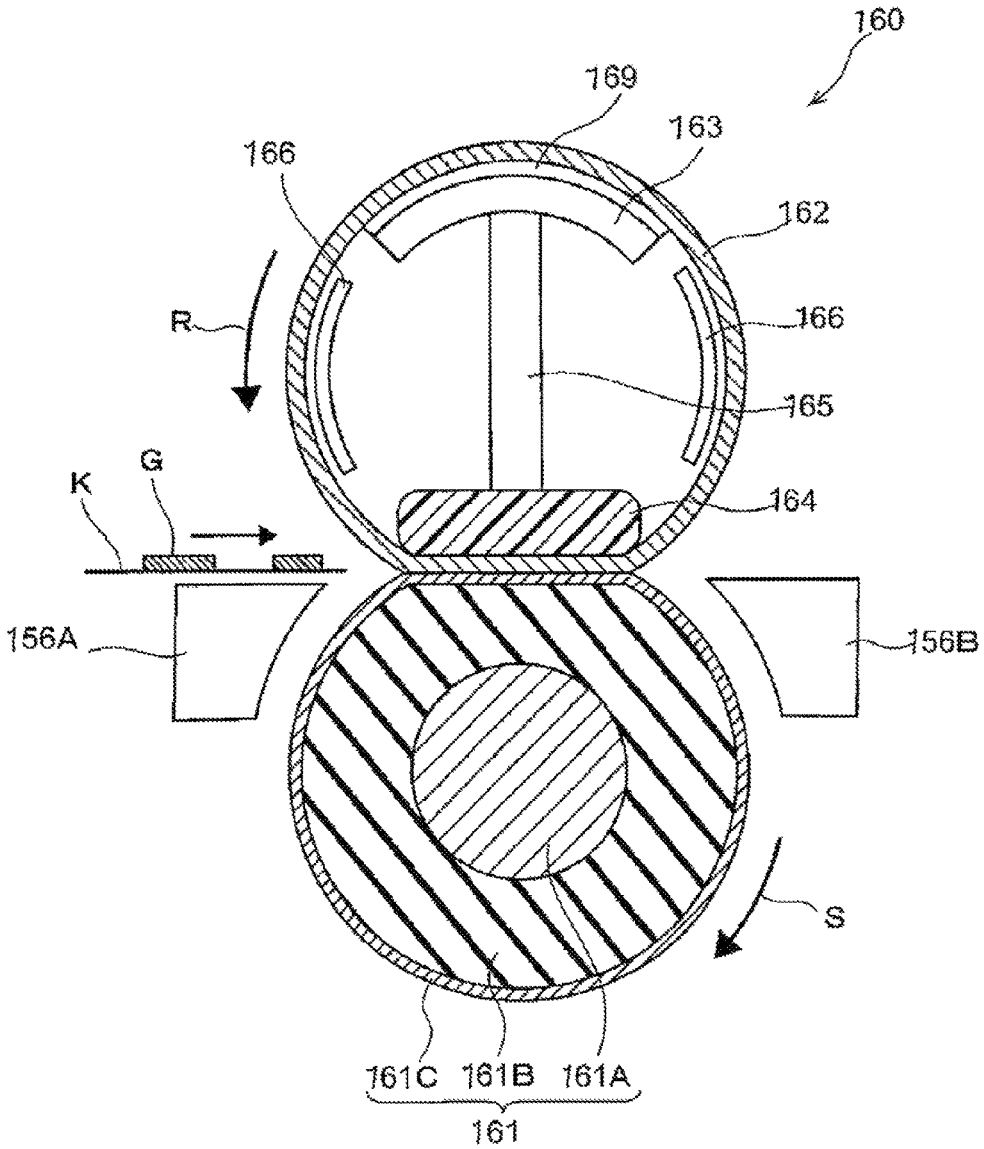
FIG. 2 is a configuration diagram illustrating another example of the fixing device in an exemplary embodiment.

FIG. 2 is a schematic diagram illustrating another example of the fixing device according to the second exemplary embodiment.

As illustrated in FIG. 2, a fixing device 160 according to the second exemplary embodiment is provided with a pressurizing roller 161 (an example of the pressurizing rotator) that rotates and a heating and fixing belt 162 (examples of the fixing belt). In addition, a pressing pad 164 (an examples of the pressing member) that presses the pressurizing roller 161 via the heating and fixing belt 162, and forms a nip portion between the heating and fixing belt 162 and the pressurizing roller 161, through which the paper K (an example of the recording medium) passes, is provided inside of the heating and fixing belt 162. Further, in the inside of the heating and fixing belt 162, a belt running guide 163 and a belt running assistant guide 166 are provided in an arc shape so as to follow the shape of the heating and fixing belt 162, and the heating and fixing belt 162 moves around the outer peripheral surfaces of the belt running guide 163, the belt running assistant guide 166, and the pressing pad 164. Note that, the belt running guide 163 and the pressing pad 164 are attached to a holder 165 in the inside of the heating and fixing belt 162. In addition, a heating element 169 (an example of the heating unit) is provided between the belt running guide 163 and the heating and fixing belt 162, as a heating source of the heating and fixing belt 162.

The pressing pad 164 is held by the metallic holder 165 in the inside of the heating and fixing belt 162. The pressing pad 164 is disposed to face the pressurizing roller 161 via the heating and fixing belt 162, and the nip portion through which the paper passes is formed between the heating and fixing belt 162 and the pressurizing roller 161 by pressing the heating and fixing belt 162 from the inner peripheral surface of the heating and fixing belt 162 to the pressurizing roller 161.

Note that, the heating and fixing belt 162 and the pressurizing roller 161 may be relatively pressurized. Accordingly, the heating and fixing belt 162 may be pressurized to the pressurizing roller 161 side by the pressing pad 164, and the pressurizing roller 161 may be pressurized to the heating and fixing belt 162 side.

In addition, in the fixing device as illustrated in FIG. 2, the pressing pad 164 constitutes the sliding member that slides on the inner peripheral surface of the heating and fixing belt 162; however, a configuration is not limited. For example, a configuration in which a low friction member (sliding member) may be formed between the pressing pad 164 which is a pressing member and the heating and fixing belt 162 may be employed.

Subsequently, an operation of the fixing device 160 will be described.

In addition, in the fixing device 160, the pressurizing roller 161 rotates in the direction of the arrow S by, for example, by a driving motor (not shown), and following this rotation, the heating and fixing belt 162 rotates in the direction of the arrow R which is opposite to the rotation direction of the pressurizing roller 161. In other words, for example, the pressurizing roller 161 rotates in the counterclockwise direction in FIG. 2; whereas, the heating and fixing belt 162 rotates in the clockwise direction.

Further, paper K having an unfixed toner image G on the surface is guided by a fixation entrance guide 156A, and is transported to a nip portion formed between the heating and fixing belt 162 and the pressurizing roller 161. When the paper K passes through the nip portion, the pressure and heat which action on the nip portion are added to the toner image G on the paper K, and the toner image G is guided and discharged by the fixation exit guide 156B so as to be fixed on the surface of the paper K.

Here, the respective members for constituting the fixing unit (fixing device) will be more specifically described.

Fixing Belt

A configuration of the fixing belt used in the exemplary embodiments will be described in detail using the drawings.

Figure 3:
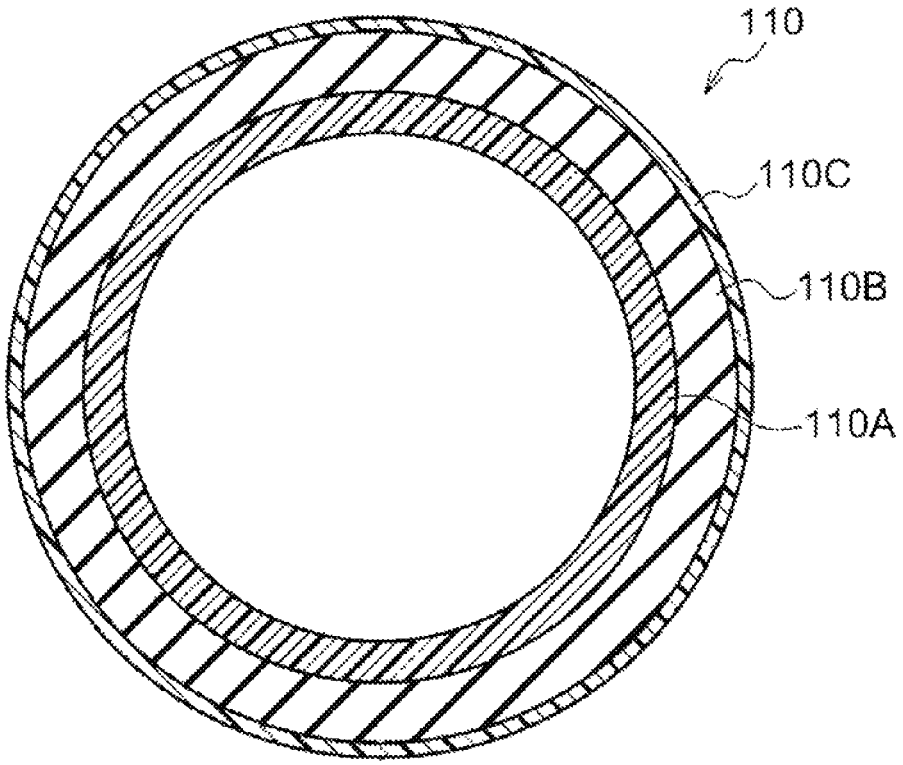
FIG. 3 is a schematic sectional view illustrating an example of the fixing belt in the exemplary embodiment.

FIG. 3 is a schematic sectional view illustrating an example of the fixing belt.

In an exemplary embodiment of the fixing belt, as illustrated in FIG. 3, a configuration in which a fixing belt 110 which is a base material 110A, an elastic layer 110B provided on the base material 110A, and a surface layer 110C provided on the elastic layer 110B is employed.

FIG. 3 illustrates a configuration of having the elastic layer 110B; however, the fixing belt of the exemplary embodiment may be configured to include a base material 110A and a surface layer 110C provided on the base material 110A without the elastic layer 110B.

Further, a configuration in which an adhesive layer is formed between the base material 110A and the elastic layer 110B, between the elastic layer 110B and the surface layer 110C, and between the base material 110A and the surface layer 110C may be employed.

Here, components of the fixing belt in the exemplary embodiment will be described without reference numerals.

Base Material

As the base material, for example, materials formed of a resin material and a metallic material may be used. In a case where the base material is used as the belt member in the fixing device, a material having the mechanical strength, the flexibility, and the like may be used, and from this viewpoint, a resin material and a metallic material are preferably used.

Examples of resin materials that may form the base material include a resin called engineering plastic.

Examples of the engineering plastic forming the base material include a fluorine resin, polyimide (PI, thermosetting polyimide, thermoplastic polyimide), fluorinated polyimide, polyamideimide (PAI), polybenzimidazole (PBI), polyetheretherketone (PEEK), polysulfone (PSU), polyethersulfone (PES), polyphenylene sulfide (PPS), polyetherimide (PEI), and whole aromatic polyester (liquid crystal polymer). Among them, polyimide, fluorinated polyimide, polyamideimide, and polyetherimide are preferable from the viewpoint of mechanical strength, heat resistance, abrasion resistance, and chemical resistance.

Note that, in a case of using the resin material, a conductive material (carbon black or the like) may be added and dispersed in the belt member so as to control the volume resistivity.

Examples of the metallic material that may form the base material include various metals such as SUS, nickel, copper, and aluminum.

In addition, the resin material and the metallic material may be laminated so as to form the base material.

The thickness of the base material is not particularly limited. For example, in a case of being used as a fixing belt, the thickness of the base material is preferably from 20 μm to 200 μm, is further preferably from 30 μm to 150 μm, and is still further preferably from 40 μm to 130 μm from the viewpoint of having the mechanical strength and securing the flexibility.

Elastic Layer

In the exemplary embodiment, the fixing belt may include an elastic layer.

The elastic layer is a layer provided from the viewpoint of imparting elasticity to the pressure applied from the outer peripheral side to the fixing belt. For example, in a case where the fixing belt is used as a heating and fixing belt in the image forming apparatus, the elastic layer plays a role of a layer in which the surface of the heating and fixing belt is adhered to the toner image in accordance with the roughness of the toner image on the recording medium.

Examples of the materials of the elastic layer include a fluorine resin, a silicone resin, silicone rubber, fluorine rubber, and fluorine silicone rubber. Among them, silicone rubber is preferably used from the viewpoint heat resistance, thermal conductivity, and insulating property.

The elastic layer may contain a filler from the viewpoint of reinforcement, heat resistance, and heat transfer. As a filler, known materials are used, and examples thereof include fumed silica, crystalline silica, iron oxide, alumina, metallic silicon, and carbide (for example, Carbon black, carbon fiber, and carbon nanotube).

The thickness of the elastic layer is preferably from 50 μm to 1,000 μm, and is further preferably from 100 μm to 600 μm.

Surface Layer

In the exemplary embodiment, a surface layer is included in the outer peripheral surface of the fixing belt.

The surface layer is required to have, for example, heat resistance and releasability. From this viewpoint, a heat-resistant release material may be used as the material forming the surface layer, and specific examples thereof include fluorine rubber, a fluorine resin, and a silicone resin.

Among them, as the heat-resistant release material, a fluorine resin is preferable.

Specifically, examples of the fluorine resin include a tetrafluoroethylene-perfluoroalkyl vinyl ether copolymer (PFA), polytetrafluoroethylene (PTFE), a tetrafluoroethylene-hexafluoropropylene copolymer (FEP), a polyethylene-tetrafluoroethylene copolymer (ETFE), polyvinylidene fluoride (PVDF), polychlorotrifluoroethylene (PCTFE), and vinyl fluoride (PVF).

In addition, examples of the materials of the surface layer include a silicone resin, silicone rubber, fluorine rubber, and fluorinated polyimide in addition to fluorine resin.

The surface on the inner peripheral side of the surface layer may be subjected to a surface treatment. The surface treatment may be a wet treatment and a dry treatment, and examples thereof include a liquid ammonia treatment, an excimer laser treatment, and a plasma treatment.

The thickness of the surface layer is preferably from 20 μm to 100 μm.

Heating Rotator

Examples of a heating rotator include a roll-shaped rotator and a belt-shaped rotator.

In the following description, an example of the roll-shaped rotator (the pressurizing roller 161) as illustrated in FIG. 2 will be described.

The pressurizing roller 161 (heating rotator) is a cylindrical roller which is provided with a core (cylindrical core bar) 161A formed of solid metal, a heat-resistant elastic layer 161B disposed in the periphery of around the core 161A, and a surface layer 161C disposed in the periphery of the heat-resistant elastic layer 161B. Examples of the pressurizing roller 161 include known pressurizing roller in accordance with the purpose without being limited to the shape, structure, and size.

Both end portions of the core 161A are rotatably supported by, for example, a bearing member (not shown) and are pressed under pressure predetermined with respect to the heating and fixing belt 162 by a biasing member such as a coil spring disposed at both end portions of the core 161A.

Examples of the material of the core 161A of the pressurizing roller 161 include metals having high thermal conductivity, such as iron, aluminum (for example, A-5052 material), SUS, and copper, or alloys, ceramics, and fiber reinforced metals (FRM).

Examples of the material of the heat-resistant elastic layer 161B of the pressurizing roller 161 include rubber having a hardness (JIS-A: hardness measured by JIS-KA type testing machine) of 15° to 160°, an elastomer, and a foamed resin, and specific examples thereof include silicone rubber, fluorine rubber, and liquid silicone rubber filled with hollow glass beads. The thickness of the heat-resistant elastic layer is not particularly, limited. For example, it is preferably from 2 mm to 20 mm, and is further preferably from 3 mm to 10 mm.

In addition, examples of the materials for the surface layer 161C of the pressurizing roller 161 include a resin. Examples of the resin forming the surface layer 161C include a fluorine resin such as a tetrafluoroethylene-perfluoroalkyl vinyl ether copolymer (PFA), polytetrafluoroethylene (PTFE), and a tetrafluoroethylene-hexafluoropropylene copolymer (FEP), a silicone resin, silicone rubber, fluorine rubber, and fluorinated polyimide from the viewpoint of the heat resistance and the releasability.

The surface layer 161C may be a conductive layer, or a layer having the volume resistivity of $1\times10^4$ Ωcm or less. Examples of the material forming the surface layer having the conductivity include a resin containing conductive particles such as carbon black, graphite and metal powder. The thickness of the surface layer is not particularly limited. For example, it is preferably from 10 μm to 200 μm, and is further preferably from 20 μm to 100 μm.

Note that, in FIG. 2, as the pressurizing roller, examples of the cylindrical roller provided with the core 161A, the heat-resistant elastic layer 161B, and the surface layer 161C is illustrated; however, the pressurizing roller is not limited the cylindrical roller. For example, a roll-shaped rotator which has no heat-resistant elastic layer but is formed of the core 161A and the surface layer 161C may be also obtained. In addition, an adhesive layer is nipped between the respective layers.

In addition, the above-described pressurizing roller may be used as a heating roller 61 illustrated FIG. 1. In this case, the pressurizing roller may be provided with a heating unit in the core.

Pressing Member

A pressing member will be described using an example of a pressing pad 164 as illustrated in FIG. 2.

The material of the pressing pad 164 is, for example, silicone rubber, fluorine rubber, a resin such as a polyimide resin, a polyamide resin, a phenol resin, a polyethersulfone (PES) resin, and a polyphenylene sulfide resin (PPS), and metals such as iron and aluminum. The resin may further contain particles having conductivity, such as carbon black, graphite, and metal powder.

Note that, the above-described pressing pad 164 may be used as the pressing pad 64 as illustrated in FIG. 1.

Sliding Member

A sliding member will be described using an example of the low friction member 68 as illustrated in FIG. 1.

The low friction member 68 may be formed of a single layer or plural layers. Examples of the material for the low friction member include a sintered PTFE resin sheet, a glass fiber sheet impregnated with fluorine resin, and a laminated sheet in which fluorine resin film sheet is heated and melted, and nipped between glass fibers.

In addition, for the low friction member, a lubricating oil permeation preventing layer for preventing the depletion of lubricating oil may be disposed. Examples of materials for the lubricating oil permeation preventing layer include a heat-resistant resin film that is heat resistant and does not allow lubricating oil to permeate, and a metal film.

In a case where the low friction member is not installed, the pressing pad 64 may be formed of, for example, a resin, metal, or the like each containing particles that may impart conductivity such that the surface contacting the inner peripheral surface of the pressurizing and fixing belt 62 has the conductivity.

Lubricating Oil

The lubricating oil may be applied to the inside of the fixing belt (the pressurizing and fixing belt 62 and the heating and fixing belt 162) in order to reduce the frictional resistance between the fixing belt and the respective members contacting the inner peripheral surface of the fixing belt such as the low friction member 68 and the pressing pad 164.

Examples of the lubricating oil include silicone oil (such as unmodified silicone oil, amino-modified silicone oil, dimethyl silicone oil, methyl phenyl silicone oil, carboxy-modified silicone oil, silanol-modified silicone oil, and sulfonic acid-modified silicone oil), fluorine oil (such as perfluoropolyether oil and modified perfluoropolyether oil), synthetic lubricating grease mixed with solid material and liquid (silicone grease and fluorine grease), and oils obtained by adding organic metal salts, and hindered amines to these oils.

Heating Unit

In the first exemplary embodiment as illustrated in FIG. 1, as a unit that heats the heating roller 61, the halogen lamp 66 is provided in the heating roller 61. In addition, in the second exemplary embodiment as illustrated in FIG. 2, as a unit that heats the heating and fixing belt 162, the heating element 169 contacting the inner peripheral surface of the heating and fixing belt 162 is provided.

The configuration of the heating unit is not limited to this, and for example, a configuration in which a resistance heating element which generates Joule heat by supplying electric power is nipped between a pair of supporting plates, and the heat generated from the resistance heating element is transmitted to an object via the supporting plates may be employed. The material of the supporting plate may be a metal such as aluminum or stainless steel from the viewpoint of heat conduction.

Configuration of Image Forming Apparatus

Next, a configuration of the image forming apparatus according to exemplary embodiment will be described with reference to the drawings.

Figure 4:
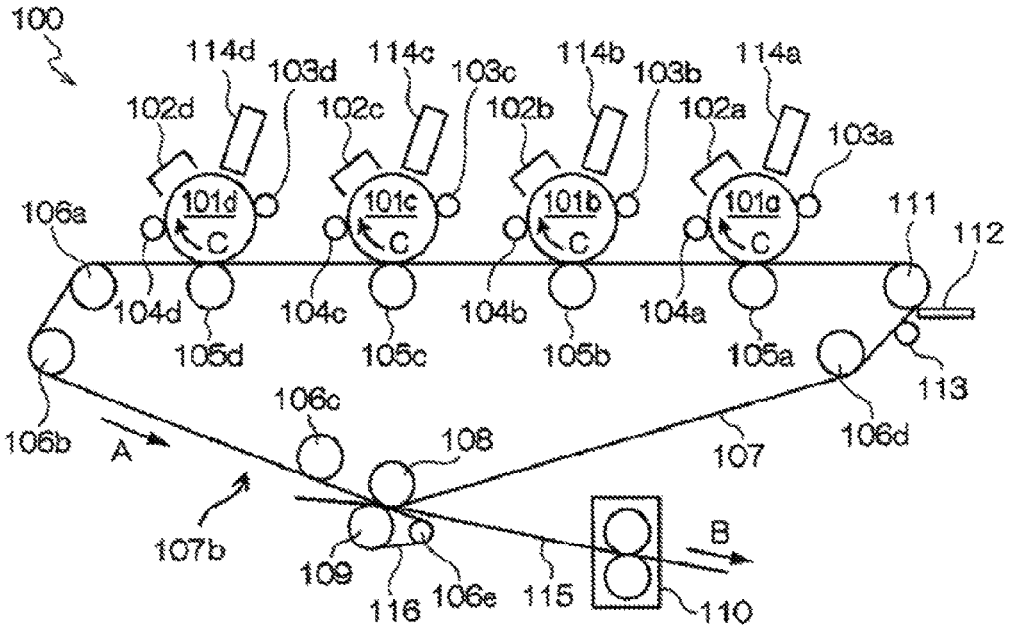
FIG. 4 is a configuration diagram illustrating an example of an image forming apparatus in the exemplary embodiment.

FIG. 4 is a configuration diagram illustrating an example of an image forming apparatus in the exemplary embodiment. The image forming apparatus as illustrated in FIG. 4 is an image forming apparatus to which the fixing device according to the exemplary embodiment is applied.

As illustrated in FIG. 4, an image forming apparatus 100 according to exemplary embodiment is, for example, a so-called tandem type image forming apparatus, and in the periphery of four image holding members 101*a* to 101*d* formed of electrophotographic photoreceptors, charging devices 102*a* to 102*d*, exposure devices 114*a* to 114*d*, developing devices 103*a* to 103*d*, primary transfer devices (the primary transfer rollers) 105*a* to 105*d*, and image holding member cleaning devices 104*a* to 104*d* are sequentially disposed along the rotation direction of the image holding members. In order to remove the residual potential remaining on the surface of the image holding members 101*a* to 101*d* after the transfer, an erasing device may be provided.

The intermediate transfer belt 107 is supported with tension applied from support rollers 106*a* to 106*d*, a driving roller 111, and a facing roller 108, and forms an endless belt unit 107*b*. With the support rollers 106*a* to 106*d*, the driving roller 111, and the facing roller 108, the intermediate transfer belt 107 may allow the image holding members 101*a* to 101*d* and the primary transfer rollers 105*a* to 105*d* to move in the direction of an arrow A while contacting the surfaces of the image holding members 101*a* to 101*d*. A portion where the primary transfer rollers 105*a* to 105*d* contacts the image holding members 101*a* to 101*d* via the intermediate transfer belt 107 is a primary transfer unit, and a primary transfer voltage is applied to a contact portion between the image holding members 101*a* to 101*d* and the primary transfer rollers 105*a* to 105*d*.

As a secondary transfer device, the facing roller 108 and a secondary transfer roller 109 are disposed face each other via the intermediate transfer belt 107 and a secondary transfer belt 116. The secondary transfer belt 116 is supported by the secondary transfer roller 109 and a support roller 106*e*. A recording medium 115 such as paper moves to an area which contacts the surface of the intermediate transfer belt 107 and is nip between the intermediate transfer belt 107 and the secondary transfer roller 109 in the direction of an arrow B, and then passes through a fixing device 110. A portion where the secondary transfer roller 109 contacts the facing roller 108 via the intermediate transfer belt 107 and the secondary transfer belt 116 is a secondary transfer unit, and a secondary transfer voltage is applied to a contact portion between the secondary transfer roller 109 and the facing roller 108. Further, intermediate transfer belt cleaning devices 112 and 113 are disposed so as to contact the intermediate transfer belt 107 after the transfer.

With this multicolor image forming apparatus 100, the image holding member 101*a* rotates in the direction of an arrow C, and the surface thereof is charged by the charging device 102*a*, and then a first color electrostatic charge image is formed by an exposure device 114*a* of a laser beam or the like. The formed electrostatic charge image is developed (visualized) with a developer containing a toner so as to form a toner image by using the developing device 103*a* that accommodates a corresponding color toner. Note that, each of the developing devices 103*a* to 103*d* contains toner (for example, yellow, magenta, cyan, and black) corresponding to each of the color electrostatic charge images.

The toner image formed on the image holding member 101*a* is electrostatically transferred (primarily transferred) onto the intermediate transfer belt 107 by the primary transfer roller 105*a* at the time of passing through the primary transfer unit. Thereafter, a second to fourth color toner images are primarily transferred by the primary transfer rollers 105*b* to 105*d* so as to be sequentially overlapped onto the intermediate transfer belt 107 holding the first color toner image, and thereby multiple toner images having multiple colors are obtained.

The multiply toner images formed on the intermediate transfer belt 107 electrostatically collectively transferred to the recording medium 115 at the time of passing through the secondary transfer unit. The recording medium 115 to which the toner images are transferred is transported to the fixing device 110, is subjected to a fixing treatment of heating and pressurizing, or heating or pressurizing, and then is discharged to the outside of the device.

The residual toner on the image holding members 101*a* to 101*d* after the primary transfer is removed by the image holding member cleaning devices 104*a* to 104*d*. On the other hand, the residual toner on the intermediate transfer belt 107 after secondarily transfer is removed by the intermediate transfer belt cleaning devices 112 and 113 for the next image forming process.

Image Holding Member

As the image holding members 101*a* to 101*d*, known electrophotographic photoreceptors are widely applied. Examples of the electrophotographic photoreceptors include an inorganic photoreceptor in which a photosensitive layer is formed of an inorganic material and an organic photoreceptor in which a photosensitive layer is formed of an organic material. With respect to the organic photoreceptor, a function-separated type photoreceptor that stacks a charge generation layer for generating charges by exposure and a charge transport layer for transporting the charges on a support such as aluminum having conductivity, and a single-layer type photoreceptor that functions of generating and transporting the charges in the same layer may be used. In addition, with respect to the inorganic photoreceptor, a photoreceptor in which the photosensitive layer is formed of amorphous silicon may be used.

Further, the shape of the image holding member is not particularly limited, and a known shape such as a cylindrical drum shape, a sheet shape, or a plate shape is adopted.

Charging Device

The charging devices 102*a* to 102*d* are not particularly limited, and for example, known discharging devices such as a contact-type charging device using a roller, a brush, a film, and a rubber blade which have the conductivity (here, "conductivity" in the charging device means that the volume resistivity is, for example, less than $10^7$ Ωcm) or the semi-conductivity (here, "semi-conductivity" in the charging device means that the volume resistivity is, for example, from $10^7$ Ωcm to $10^{13}$ Ωcm), a scorotron charging device using corona discharge, and a corotron charging device are widely applied. Among them, the contact-type charging device is preferably used.

The charging devices 102*a* to 102*d* generally apply a direct current to the image holding members 101*a* to 101*d*, but may apply an alternating current further superimposed.

Exposure Device

The exposure devices 114*a* to 114*d* are not particularly limited. For example, known exposure devices such as an optical device that exposes light according to an image data on the surfaces of the image holding members 101*a* to 101*d* via light sources such as a semiconductor laser beam, light emitting diode (LED) light, and liquid crystal shutter light or a polygon mirror from the light sources is widely applied.

Developing Device

The developing devices 103*a* to 103*d* are selected according to the purpose. For example, a known developing device that develops an image with a one-component type developer or a two-component type developer by using a brush, a roller or the like in a contact or noncontact manner.

Intermediate Transfer Belt

The intermediate transfer belt 107 is formed of a film-shaped pressure belt in which an appropriate amount of an antistatic agent such as carbon black is contained with a resin such as polyimide, polyamide, and polyamide imide as a base layer. In addition, the volume resistivity thereof is from $10^6$ Ωcm to $10^{14}$ Ωcm, and the thickness thereof is, for example, approximately 0.1 mm.

Primary Transfer Roller

The primary transfer rollers 105*a* to 105*d* may be either a single layer or multiple layers. For example, the single layer is formed of a roller which is obtained by mixing an appropriate amount of conductive particles such as carbon black to foamed or non-foamed silicone rubber, urethane rubber, EPDM, or the like.

Image Holding Member Cleaning Device

The image holding member cleaning devices 104*a* to 104*d* are to remove residual toner attached on the surfaces of the image holding members 101*a* to 101*d* after the primary transfer step, and as the examples thereof, a brush cleaning blade or a roller cleaning blade or the like is used in addition to the cleaning blade. Among them, the cleaning blade is preferably used. Further, examples of the material of the cleaning blade include urethane rubber, neoprene rubber, and silicone rubber.

Secondary Transfer Roller

The layer structure of the secondary transfer roller 109 is not particularly limited. For example, a three-layer structure is formed of, for example, of a core layer, an intermediate layer, and a coating layer covering the surface. The core layer is formed of a foamed material of silicone rubber, urethane rubber, or EPDM in which the conductive particles are dispersed, and an intermediate layer is formed of a non-foamed material thereof. Examples of the materials of the coating layer include a tetrafluoroethylene-hexafluoropropylene copolymer and a perfluoroalkoxy resin. The volume resistivity of the secondary transfer roller 109 is preferably $10^7$ Ωcm or less. Further, a two-layer structure excluding the intermediate layer may be employed.

Facing Roller

The facing roller 108 forms a counter electrode of the secondary transfer roller 109. The layer structure of the facing roller 108 may be either a single layer or a multilayer. For example, the single layer structure is formed of a roller which is obtained by mixing an appropriate amount of conductive particles such as carbon black to silicone rubber, urethane rubber, EPDM, or the like. The second layer structure is formed of a roller in which the outer peripheral surface of the elastic layer formed of the above rubber material is coated with a high resistant layer.

Typically, a voltage of 1 kV to 6 kV is applied to cores of the facing roller 108 and the secondary transfer roller 109. Instead of applying a voltage to the core of the facing roller 108, a voltage may be applied to the electrically conductive electrode member contacting the facing roller 108 and the secondary transfer roller 109. Examples of the electrode member include a metal roller, a conductive rubber roller, a conductive brush, a metal plate, and a conductive resin plate.

Intermediate Transfer Belt Cleaning Device

Examples of the intermediate transfer belt cleaning devices 112 and 113 include a brush cleaning blade and a roller cleaning blade, in addition to the cleaning blade or the like is used. Among them, the cleaning blade is preferably used. Further, examples of the material of the cleaning blade include urethane rubber, neoprene rubber, and silicone rubber.

Electrostatic Charge Image Developing Toner

Next, in the image forming apparatus according to the exemplary embodiment, the electrostatic charge image developing toner contained in the electrostatic charge image developer accommodated in the developing unit will be described in detail.

In the exemplary embodiment, the above-described specific pulverized toner is used as the electrostatic charge image developing toner. That is, as the toner, a toner which includes toner particles (pulverized toner particles) containing a binder resin which contains an amorphous resin and a crystalline resin, and paraffin wax having a melting temperature from 60° C. to 80° C. is used, and in the toner, the absolute value of a difference between the melting temperature of the crystalline resin and the melting temperature of the paraffin wax is 10° C. or less, the volume average particle diameter of the toner particles is from 6 μm to 9 μm, a shape factor SF1 of the toner particles is 140 or more, and a toluene-insoluble portion of the toner is from 25% by weight to 45% by weight.

Hereinafter, components of the toner in the exemplary embodiment will be described.

Toner Particles

The toner particles are configured to include a binder resin, a release agent containing at least specific paraffin wax, and if necessary, a coloring agent and other additives.

Binder Resin

As the binder resin, an amorphous resin and a crystalline resin are used in combination. With respect to the binder resin, the crystalline resin is used in combination with the amorphous resin, thereby providing excellent low temperature fixability.

Here, the amorphous resin means a resin having only a stepwise endothermic change without a definite endothermic peak in a thermal analysis measurement using differential scanning calorimetry (DSC), and is a solid at room temperature and thermoplastic at a temperature equal to or higher than a glass transition temperature.

On the other hand, the crystalline resin means a resin having a definite endothermic peak without a stepwise endothermic change in the differential scanning calorimetry (DSC).

Specifically, for example, the crystalline resin means that the half-width of the endothermic peak when measured at a heating rate of 10° C./min is within 10° C., and the amorphous resin means a resin having the half-width of greater than 10° C., or a resin in which the definite endothermic peak is not recognized.

Examples of the binder resin include vinyl resins formed of homopolymer of monomers such as styrenes (for example, styrene, para-chloro styrene, and α-methyl styrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (for example, acrylonitrile, and methacrylonitrile), vinyl ethers (for example, vinyl methyl ether, and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

As the binder resin, there are also exemplified non-vinyl resins such as an epoxy resin, a polyester resin, a polyurethane resin, a polyamide resin, a cellulose resin, a polyether resin, and modified rosin, a mixture thereof with the above-described vinyl resins, or a graft polymer obtained by polymerizing a vinyl monomer in the coexistence of such non-vinyl resins.

As the binder resin, two or more of the resins including the amorphous resin and the crystalline resin may be used in combination.

As the binder resin, a polyester resin is preferably used.

In the exemplary embodiment, it is preferable that the amorphous polyester resin and the crystalline polyester resin are used in combination. Note that, the content of the crystalline polyester resin may be from 2% by weight to 40% by weight (preferably from 2% by weight to 20% by weight) with respect to the entire binder resins.

Amorphous Polyester Resin

Examples of the amorphous polyester resin include condensation polymers of a polyvalent carboxylic acid and a polyol. A commercially available product or a synthesized product may be used as the amorphous polyester resin.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalic acid, and naphthalene dicarboxylic acid), and an anhydride thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acids may be used alone and two or more types thereof may be used in combination.

Examples of the polyol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), and aromatic diol (for example, an ethylene oxide adduct of bisphenol A, and a propylene oxide adduct of bisphenol A). Among these, for example, aromatic diols and alicyclic diols are preferably used, and aromatic diols are further preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyol may be used alone and two or more types thereof may be used in combination.

The glass transition temperature (Tg) of the amorphous polyester resin is preferably in a range of 50° C. to 80° C., and further preferably in a range of 50° C. to 65° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K 7121-1987 "testing methods for transition temperatures of plastics".

The weight average molecular weight (Mw) of the amorphous polyester resin is preferably from 5,000 to 1,000,000, and is further preferably from 7,000 to 500,000.

The number average molecular weight (Mn) of the amorphous polyester resin is from 2,000 to 100,000.

The molecular weight distribution Mw/Mn of the amorphous polyester resin is preferably from 1.5 to 100, and is further preferably from 2 to 60.

The weight average molecular weight and the number average molecular weight are measured by gel permeation chromatography (GPC). The molecular weight measurement by GPC is performed using GPC.HLC-8120 GPC, manufactured by Tosoh Corporation as a measuring device, Column TSK GEL SUPER HM-M (15 cm), manufactured by Tosoh Corporation, and a THF solvent. The weight average molecular weight and the number average molecular weight are calculated by using a molecular weight calibration curve plotted from a monodisperse polystyrene standard sample from the results of the foregoing measurement.

A known preparing method is used to produce the amorphous polyester resin. Specifically, examples include a method of conducting a reaction at a polymerization temperature set to be from 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

Crystalline Polyester Resin

Examples of the crystalline polyester resin include condensation polymers of a polyvalent carboxylic acid and a polyol. A commercially available product or a synthesized product may be used as the crystalline polyester resin.

Here, in order to easily form a crystal structure, the crystalline polyester resin may be a polycondensate using a polymerizable monomer having a linear aliphatic group rather than a polymerizable monomer having an aromatic group.

Examples of the polyvalent carboxylic acid include aliphatic dicarboxylic acid (for example, oxalic acid, succinic acid, glutaric acid, adipic acid, suberic acid, azelaic acid, sebacic acid, 1,9-nonane dicarboxylic acid, 1,10-decane dicarboxylic acid, 1,12-dodecane dicarboxylic acid, 1,14-tetradecane dicarboxylic acid, and 1,18-octadecane dicarboxylic acid), aromatic dicarboxylic acid (for example, dibasic acid such as phthalic acid, isophthalic acid, terephthalic acid, and naphthalene-2,6-dicarboxylic acid), and an anhydride thereof, or lower alkyl esters (having, for example, from 1 to 5 carbon atoms) thereof.

As the polyvalent carboxylic acid, tri- or higher-valent carboxylic acid employing a crosslinked structure or a branched structure may be used in combination together with dicarboxylic acid. Examples of the tri-valent carboxylic acid include an aromatic carboxylic acid (for example, 1,2,3-benzene tricarboxylic acid, 1,2,4-benzene tricarboxylic acid, and 1,2,4-naphthalene tricarboxylic acid), and an anhydride thereof, or a lower alkyl ester (having, for example, 1 to 5 carbon atoms) thereof.

As the polycarboxylic acid, a dicarboxylic acid having a sulfonic acid group and a dicarboxylic acid having an ethylenic double bond may be used together with these dicarboxylic acids.

The polyvalent carboxylic acids may be used alone and two or more types thereof may be used in combination.

Examples of the polyol include aliphatic diol (for example, a linear type aliphatic diol having the carbon number of a main chain portions is from 7 to 20). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedanediol. Among them, as the aliphatic diol, 1,8-octanediol, 1,9-nonanediol, and 1,10-decanediol are preferably used.

As the polyol, a tri- or higher-valent polyol employing a crosslinked structure or a branched structure may be used in combination together with diol. Examples of the tri- or higher-valent polyol include glycerin, trimethylolethane, trimethylolpropane, and pentaerythritol.

The polyol may be used alone and two or more types thereof may be used in combination.

Here, in the polyol, the content of the aliphatic diol may be 80% by mol or more, and is preferably 90% by mol or more.

The melting temperature of the crystalline polyester resin is preferably from 50° C. to 90° C., is further preferably from 55° C. to 90° C., and is still further preferably from 60° C. to 85° C.

Note that, the melting temperature is obtained from a DSC curve obtained by differential scanning calorimetry (DSC), and specifically obtained from "melting peak temperature" described in the method of obtaining a melting temperature in JIS K 7121-1987 "testing methods for transition temperatures of plastics".

The weight average molecular weight (Mw) of the crystalline polyester resin is preferably from 6,000 to 35,000.

Note that, the weight average molecular weight of the crystalline polyester resin is measured based on the method by gel permeation chromatography (GPC) in the amorphous polyester resin.

The crystalline polyester resin is obtained by a known preparing method similar to the case of the amorphous polyester resin.

The content of the crystalline resin (preferably a crystalline polyester resin) is preferably from 3% by weight to 20% by weight, and is preferably from 5% 5% by weight to 15% by weight with respect to the entire amount of the toner.

When the content of the crystalline resin is within the above range, it is possible to obtain excellent low temperature fixability.

Release Agent

Specific Paraffin Wax

The toner particles at least contain paraffin wax (specific paraffin wax) having a melting temperature of from 60° C. to 80° C., as a release agent. The melting temperature of the specific paraffin wax is preferably from 65° C. to 78° C., and is further preferably from 65° C. to 75° C.

When the melting temperature of the paraffinic wax is 80° C. or less, the excellent low temperature fixability is obtained; whereas, when the melting temperature is 60° C. or more, the storage stability of the toner is enhanced.

Note that, the melting temperature is obtained from a DSC curve obtained by differential scanning calorimetry (DSC), and specifically obtained from "melting peak temperature" described in the method of obtaining a melting temperature in JIS K 7121-1987 "testing methods for transition temperatures of plastics".

Examples of the paraffin wax include polyethylene type wax and polypropylene type wax.

Note that, the toner particles may contain release agents (hereinafter, may be simply referred to as "other release agents") other than specific paraffin wax.

Examples of other release agents include paraffin wax having a melting temperature of lower than 60° C. or higher than 80° C.; hydrocarbon wax other than paraffinic wax; natural waxes such as carnauba wax, rice wax, and candelilla wax; synthetic or mineral/petroleum waxes such as montan wax; and ester waxes such as fatty acid esters and montanic acid esters. However, other release agents are not limited to the above examples.

The content of the release agent is preferably from 1% by weight to 20% by weight, and is preferably from 5% by weight to 15% by weight with respect to the toner particles.

Note that, in a case where the toner particles contain other release agents, the content of the specific paraffin wax having a melting temperature from 60° C. to 80° C. is preferably greater than 50% by weight, and is further preferably 60% by weight or more with respect to the entire amount of the release agent.

Absolute Value of Difference Between Melting Temperature of Crystalline Resin and Melting Temperature of Paraffin Wax The toner particles in the exemplary embodiment include the crystalline resin and the specific paraffin wax having the melting temperature from 60° C. to 80° C., and the absolute value of the difference between the melting temperature of the crystalline resin and the melting temperature of the specific paraffin wax is 10° C. or less. The absolute value of the above difference is preferably 8° C. or less, is further preferably 5° C. or less, and the smaller the absolute value of the difference is, the better.

The absolute value of the difference in the melting temperature of the crystalline resin and the specific paraffin wax is 10° C. or less, and thus it is possible to obtain excellent fixibility.

Coloring Agent

Examples of the coloring agent includes various types of pigments such as carbon black, chrome yellow, Hansa yellow, benzidine yellow, threne yellow, quinoline yellow, pigment yellow, Permanent Orange GTR, Pyrazolone Orange, Vulcan Orange, Watch Young Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate, or various types of dyes such as acridine dye, xanthene dye, azo dye, benzoquinone dye, azine dye, anthraquinone dye, thioindigo dye, dioxazine dye, thiazine dye, azomethine dye, indigo dye, phthalocyanine dye, aniline black dye, polymethine dye, triphenylmethane dye, diphenylmethane dye, and thiazole dye.

The coloring agents may be used alone and two or more types thereof may be used in combination.

As the coloring agent, if necessary, a surface-treated coloring agent may be used, or a dispersant may be used in combination. Further, plural kinds of coloring agents may be used in combination.

The content of the coloring agent is preferably from 1% by weight to 30% by weight, and is further preferably from 3% by weight to 15% by weight with respect to the total amount of the toner particles.

Other Additives

Examples of other additives include well-known additives such as a magnetic material, a charge-controlling agent, and an inorganic powder. These additives are contained in the toner particle as an internal additive.

Volume Average Particle Diameter of Toner Particles

The volume average particle diameter of the toner particles is from 6 μm to 9 μm, is preferably from 6.5 μm to 8 μm, and is further preferably from 6.5 μm to 7.5 μm.

When the volume average particle diameter of the toner particles is 6 μm or more, the preparing suitability at the time of the preparation by the pulverization method is obtained. On the other hand, when the volume average particle diameter is 9 μm or less, high quality images are easily obtained.

The volume average particle diameter of the toner particles is measured using a COULTER MULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to from 2 ml of a 5% aqueous solution of surfactant (preferably sodium alkylbenzene sulfonate) as a dispersing agent. The obtained material is added to from 100 ml to 150 ml of the electrolyte.

The electrolyte in which the sample is suspended is subjected to a dispersion treatment using an ultrasonic disperser for one minute, and a particle diameter distribution of particles having a particle diameter of from 2 μm to 60 μm is measured by a COULTER MULTISIZER II with an aperture having an aperture diameter of 100 μm. 50,000 particles are sampled.

Cumulative distributions by volume are drawn from the side of the smallest diameter with respect to particle diameter ranges (channels) separated based on the measured particle diameter distribution, and then the particle diameter when the cumulative percentage becomes 50% is defined as volume average particle diameter D50v.

Shape Factor SF1 of Toner Particles

The shape factor SF1 of the toner particles is 140 or more, is preferably 143 or more, and is further preferably 145 or more. When the shape factor SF1 of the toner particles is 140 or more, the preparing suitability at the time of the preparation by the pulverization method is obtained.

On the other hand, the upper limit value of the shape factor SF1 is preferably 155 or less, is further preferably 153 or less, and is still further preferably 151 or less from the viewpoint that a shape close to a sphere is provided, thereby easily obtaining a high quality image.

In addition, the toner particles having the shape factor SF1 of 140 or more are generally prepared by using the pulverization method such as a kneading and pulverizing method. A method of preparing the toner particles by using the pulverization method will be described below.

The shape factor SF1 is calculated by the following Expression.

$$SF1=(ML^2/A)\times(\pi/4)\times 100 \qquad \text{Expression:}$$

In the above Expression, ML represents an absolute maximum length of the toner, and A represents a projected area of the toner.

Specifically, the shape factor SF1 is digitized by analyzing mainly a microscope image or a scanning electron microscope (SEM) image using an image analyzer, and is calculated as follows. That is, the shape factor SF1 is obtained by capturing an optical microscopic image of particles scattered on the surface of a slide glass into a LUZEX image analyzer by using a video camera, and measuring the maximum length and the projected area of 100 particles, calculation is performed according to the above Expression, and the average value is obtained.

External Additives

In the exemplary embodiment, from the viewpoint of improving the transfer properties of the toner image, the cleaning properties of the toner particles, and the like, the external additives may be added to the surface of the toner particles.

Examples of the external additives include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

Surfaces of the inorganic particles as an external additive may be treated with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive include a resin particle (resin particle such as polystyrene, polymethyl methacrylate (PMMA), and melamine resin), a cleaning aid (for example, metal salts of higher fatty acids typified by zinc stearate, and particles having fluorine high molecular weight polymer).

The external addition amount of the external additives is, for example, preferably from 0.01% by weight to 5% by weight, and is further preferably from 0.01% by weight to 2.0% by weight with respect to the toner particles.

Toluene-Insoluble Portion of Toner

In the toner in the exemplary embodiment, the content of the toluene-insoluble portion is from 25% by weight to 45% by weight. The toluene-insoluble portion is preferably from 28% by weight to 38% by weight, and is further preferably from 30% by weight to 35% by weight.

When the toluene-insoluble portion is 25% by weight or more, the excellent low temperature fixability is likely to be obtained and glossiness (gross) in an image is likely to be prevented from being increased as compared with the case where the toluene-insoluble portion is lower than the above range.

On the other hand, when the toluene-insoluble portion is 45% by weight or less, it is likely to obtain the excellent low temperature fixability as compared with the case where the toluene-insoluble portion is greater than the above range.

Here, the toluene-insoluble portion is toluene-insoluble components among components constituting the toner. In other words, the toluene-insoluble portion is an insoluble portion which contains a toluene-insoluble components contained in the binder resin (particularly, the high molecular weight component of the binder resin) as the main component (for example, 50% by weight or more with respect to the entire components). This toluene-insoluble portion may be said as an index of the content of crosslinked resin contained in the toner.

The toluene-insoluble portion is a value measured by the following method.

1 g of weighed toner is put into a weighed cylindrical filter paper made of glass fiber and placed in an extraction tube of a heating type Soxhlet extraction apparatus. Then, toluene is put into the flask, and is heated to 110° C. using a mantle heater. Also, the circumference of an extraction pipe is heated to 125° C. using a heater mounted on the extraction pipe. Extraction is performed with such a reflux rate that an extraction cycle is once in the range from 4 minutes to 5 minutes. After extracting for 10 hours, the cylindrical filter paper and the toner residue are taken out, dried, and weighed.

In addition, based on Expression: toner residue amount (% by weight)=[(cylindrical filter paper amount+toner residue amount) (g)−cylindrical filter paper amount (g)]/toner amount (g)×100, the toner residue amount (% by weight) is calculated, and the calculated toner residue amount (% by weight) is designated as the toluene-insoluble portion (% by weight).

Note that, the toner residue is formed of coloring agent, inorganic substances such as external additives, a high molecular weight component of the binder resin and the like. In addition, in a case where the release agent is contained in the toner particles, the extraction is performed by heating, and thus the release agent is set as the toluene soluble portion.

The toluene-insoluble portion is adjusted, in the binder resin, by 1) a method of forming a crosslinked structure or a branched structure by adding a crosslinking agent to a polymer component having a reactive functional group at the terminal, 2) a method of forming a crosslinked structure or a branched structure by a polyvalent metal ion in a polymer component having an ionic functional group at the terminal, and 3) a method of forming the extension and branch of the resin change length by performing a treatment with an isocyanate or the like.

Preparing Method of Toner

Next, a method of preparing the toner in the exemplary embodiment will be described.

The toner in the exemplary embodiment is obtained by adding an external additive to the toner particles after preparing the toner particles.

As described above, the toner particles in the exemplary embodiment are irregular toner particles (that is, the shape factor SF1 is 140 or more). The toner particles are generally prepared according to the pulverization method such as a kneading and pulverizing method.

The kneading and pulverizing method is a method of preparing the toner particles by melting and kneading the binder resin and the release agent containing the specific paraffin wax having a melting temperature within the above-described range, and then pulverizing and classifying the resultant. In the kneading and pulverizing method, for example, the toner particles are prepared through a kneading step of melting and kneading components containing the binder resin and the release agent, a cooling step of cooling the molten-kneading material, a pulverizing step of pulverizing the kneaded material after cooling, and a classification step of classifying the pulverized material.

Hereinafter, each step of the kneading and pulverizing method will be described in detail.

Kneading Step

The kneading step is a step of obtaining a kneaded material by melting and kneading a component containing a binder resin and a release agent (resin particle forming material).

Examples of a kneading machine used in the kneading step include a three-roll extruder, a single-screw extruder, a twin-screw extruder, and a banbury mixer extruder.

In addition, the melting temperature may be determined in accordance with the kinds and a blend ratio of the binder resin and the release agent to be kneaded.

Cooling Step

A cooling step is a step of cooling the kneaded material formed in the above-described kneading step.

In the cooling step, the temperature of the kneaded material at the time of completing the kneading step may be cooled down to be 40° C. or less at an average temperature lowering speed of 4° C./sec or more in order to keep the dispersed state immediately after the kneading step.

Note that, the average temperature lowering speed means an average value of the speed at which the temperature of the kneaded material at the time of completing the kneading step is cooled down to 40° C.

Examples of the cooling method in the cooling step include a method of using a rolling roller which circulates cold water or brine, and a pinched type cooling belt. Note that, in a case where the cooling is performed according to the above-described method, the cooling speed is determined by a speed of the rolling roller, a flow rate of the brine, a supply amount of the kneaded material, a slab thickness during the rolling of the kneaded material or the like. The slab thickness is preferably from 1 mm to 3 mm.

Pulverizing Step

The kneaded material which is cooled in the cooling step is pulverized in the pulverizing step so as to form a particle.

In the pulverizing step, for example, a mechanical pulverizer, a jet type pulverizer, or the like is used.

Classification Step

The pulverized materials (particles) obtained in the pulverizing step may be classified in the classification step so as to obtain toner particles of the volume average particle diameter from 6 μm to 9 μm, if necessary.

In the classification step, fine powder (particles smaller than the target diameter range) and coarse powder (particles larger than the target range) are removed by using a centrifugal classifier, an inertial classifier, or the like which is used generally.

Through the above steps, it is possible to obtain the toner particles of which the shape factor SF1 is 140 or more, and the volume average particle diameter is from 6 μm to 9 μm.

The toner in the exemplary embodiment is prepared by adding and mixing, for example, an external additive to the obtained dry toner particles. The mixing may be performed by, for example, a V-blender, a HENSCHEL MIXER, a LODIGE MIXER, or the like. Furthermore, if necessary, coarse particles of the toner may be removed by using a vibration sieving machine, a wind classifier, or the like.

Electrostatic Charge Image Developer

The electrostatic charge image developer in the exemplary embodiment includes at least the above-described toner.

The electrostatic charge image developer in the exemplary embodiment may be a one-component developer only including the above-described toner, or may be a two-component developer obtained by mixing the toner and carrier.

The carrier is not particularly limited, and a well-known carrier may be used. Examples of the carrier include a coating carrier in which the surface of the core formed of magnetic particles is coated with the coating resin; a magnetic particle dispersion-type carrier in which the magnetic particle is dispersed and distributed in the matrix resin; and a resin impregnated-type carrier in which a resin is impregnated into the porous magnetic particles.

Note that, the magnetic particle dispersion-type carrier and the resin impregnated-type carrier may be a carrier in which the forming particle of the carrier is set as a core and the core is coated with the coating resin.

Examples of the magnetic particle include a magnetic metal such as iron, nickel, and cobalt, and a magnetic oxide such as ferrite, and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin containing an organosiloxane bond or a modified product thereof, a fluorine resin, a polyester, a polycarbonate, a phenol resin, and an epoxy resin.

Note that, other additives such as the conductive particles may be contained in the coating resin and the matrix resin.

Examples of the conductive particle include metal such as gold, silver, and copper, carbon black, titaniumoxide, zinc oxide, tin oxide, barium sulfate, aluminum borate, and potassium titanate.

Here, in order to coat the surface of the core with the coating resin, a method of coating the surface with a coating layer forming solution in which the coating resin and various additives if necessary are dissolved in a proper solvent is used. The solvent is not particularly limited as long as a solvent is selected in consideration of a coating resin to be used and coating suitability.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the flowing air, and a kneader coating method of mixing the core of the carrier with the coating layer forming solution and removing a solvent in the kneader coater.

The mixing ratio (weight ratio) of the toner to the carrier in the two-component developer is preferably from toner: carrier=1:100 to 30:100, and is further preferably from 3:100 to 20:100.

EXAMPLES

Hereinafter, the exemplary embodiments will be described in detail using Examples and Comparative examples, but is not limited to the following examples.

Developer

Preparation of Crystalline Resin (A)

Dimethyl sebacate: 100 parts by weight
Hexane diol: 67.8 parts by weight
Dibutyl tin oxide: 0.10 parts by weight The respective components of the above composition are put into a three-necked flask, the mixture is reacted at 185° C. for five hours under nitrogen atmosphere while removing water generated during the reaction to the outside, and after raising the temperature up to 220° C. while slowly depressurizing, the mixture is reacted for six hours, and then the resultant is cooled. Thus, a crystalline resin (A) having a weight average molecular weight of 33,700 is prepared.

Note that, the melting temperature of the crystalline resin (A) is obtained from a DSC curve obtained by differential scanning calorimetry (DSC) based on "melting peak temperature" described in the method of obtaining a melting temperature in JIS K 7121-1987 "testing methods for transition temperatures of plastics", and the measured temperature is 71'C.

Preparation of Amorphous Resin (1)

Dimethyl terephthalate: 61 parts by weight
Dimethyl fumarate: 75 parts by weight
Dodecenylsuccinic anhydride: 34 parts by weight
Trimellitic acid: 16 parts by weight
Bisphenol A ethylene oxide adduct: 137 parts by weight
Bisphenol A propylene oxide adduct: 191 parts by weight
Dibutyl tin oxide: 0.3 parts by weight The respective components of the above composition are put into a three-necked flask, the mixture is reacted at 180° C. for three hours under nitrogen atmosphere while removing water generated during the reaction to the outside, and after raising the temperature up to 240° C. while slowly depressurizing, the mixture is reacted for two hours, and then the resultant is cooled. Thus, an amorphous resin (1) having a weight average molecular weight of 17,100 is prepared.

Preparation of Amorphous Resin (2)

Dimethyl terephthalate: 60 parts by weight
Dimethyl fumarate: 74 parts by weight
Dodecenylsuccinic anhydride: 30 parts by weight
Trimellitic acid: 22 parts by weight An amorphous resin (2) is prepared in the same manner as in the preparation of the amorphous resin (1) except that the component compositions are changed to the above compositions. The weight average molecular weight of the amorphous resin (2) is 17,500.

Preparation of Amorphous Resin (3)

Dimethyl terephthalate: 60 parts by weight
Dimethyl fumarate: 70 parts by weight
Dodecenylsuccinic anhydride: 29 parts by weight
Trimellitic acid: 29 parts by weight An amorphous resin (3) is prepared in the same manner as in the preparation of the amorphous resin (1) except that the component compositions are changed to the above compositions. The weight average molecular weight of the amorphous resin (3) is 16,600.

Preparation of Amorphous Resin (4)

Dimethyl terephthalate: 55 parts by weight
Dimethyl fumarate: 64 parts by weight
Dodecenylsuccinic anhydride: 27 parts by weight
Trimellitic acid: 46 parts by weight An amorphous resin (4) is prepared in the same manner as in the preparation of the amorphous resin (1) except that the component compositions are changed to the above compositions. The weight average molecular weight of the amorphous resin (4) is 15,100.

Preparation of Toner Particles (1)

79 parts by weight of amorphous resin (1), 7 parts by weight of coloring agent (C.I. Pigment Blue 15:1), 5 parts by weight of release agent (paraffin wax, melting temperature 73° C., prepared by Nippon Seiro Co., Ltd.), and 8 parts by weight of the crystalline resin (A) (melting temperature 71° C.) are put into a HENSCHEL MIXER (manufactured by NIPPON COKE & ENGINEERING Co., Ltd.), and are mixed and stirred at a peripheral speed of 15 m/sec for five minutes, and then the obtained stirred mixture is molten-kneaded by an extruder type continuous kneader.

Here, the setting condition of the extruder is that a supply side temperature is 160° C., a discharge side temperature is 130° C., and the supply side temperature and the discharge side temperature of the cooling roller are 40° C. and 25° C., respectively. Note that, the temperature of the cooling belt is set to be 10° C.

After being cooled, the obtained molten-kneading material is roughly pulverized by using a hammer mill, is finely pulverized such that a diameter thereof becomes 6.5 μm by a jet mill-pulverizer (manufactured by Nippon Pneumatic Mfg. Co., Ltd.), and then is classified by an elbow jet classifier (Nittetsu Mining Co., Ltd. Model: EJ-LABO), thereby obtaining toner particles (1).

As a result of measuring the volume average particle diameter and SF1 of the toner particles (1) by using the above-described method, the volume average particle diameter is 6.9 μm, and the shape factor SF1 is 145.

Preparation of Toner (1)

100 parts by weight of the toner particles (1) and 1.2 parts by weight of commercially available fumed silica RX50 (prepared by Nippon Aerosil Co., Ltd.) as the external additives are mixed at a peripheral speed of 30 m/s, for five minutes by a HENSCHEL MIXER (manufactured by Mitsui Miike Machinery Co., Ltd.). As a result, a toner (1) is obtained.

Preparation of Toner (2)

Toner particles (2) are obtained in the same manner as in the case of the toner particles (1) except that an amorphous resin (2) is used instead of the amorphous resin (1).

The volume average particle diameter of the toner particles (2) is 6.8 μm, and the shape factor SF1 is 147.

Then, a toner (2) is obtained in the same manner as in the case of the toner (1) except that the toner particles (2) are used.

Preparation of Toner (3)

Toner particles (3) are obtained in the same manner as in the case of the toner particles (1) except that an amorphous resin (3) is used instead of the amorphous resin (1).

The volume average particle diameter of the toner particles (3) is 7.0 μm, and the shape factor SF1 is 149.

Then, a toner (3) is obtained in the same manner as in the case of the toner (1) except that the toner particles (3) are used.

Preparation of Toner (4)

Toner particles (4) are obtained in the same manner as in the case of the toner particles (1) except that an amorphous resin (4) is used instead of the amorphous resin (1).

The volume average particle diameter of the toner particles (4) is 7.3 μm, and the shape factor SF1 is 151.

Then, a toner (4) is obtained in the same manner as in the case of the toner (1) except that the toner particles (4) are used.

Preparation of Toner (1C) for Comparative Example

Toner particles (1C) are obtained in the same manner as in the case of the toner particles (1) except that paraffin wax (HNP9, melting temperature 77° C., prepared by Nippon Seiro Co., Ltd.) is used instead of paraffin wax used in the toner particles (1).

The volume average particle diameter of the toner particles (1C) is 7.0 μm, and the shape factor SF1 is 146.

Then, a toner (1C) is obtained in the same manner as in the case of the toner (1) except that the toner particles (1C) are used.

Measuring of Toluene-Insoluble Portion

The toluene-insoluble portion of the toner obtained in each Example is measured by using the above-described method. The results are shown in Table 1.

Preparation of Developer

A two-component developer is prepared by mixing 8 parts by weight of toner obtained in each example and 100 parts by weight of carrier.

The carrier is obtained in such a manner that 100 parts by weight of ferrite particles (the volume average particle diameter: 50 μm), 14 parts by weight of toluene, and 2 parts by weight of styrene-methyl methacrylate copolymer (component ratio: styrene/methyl methacrylate=90/10, the weight average molecular weight Mw=80,000) are prepared, then these components except for ferrite particles are dispersed by being stirred for 10 minutes with a stirrer so as to prepare a coating solution. Then, the coating solution and the ferrite particles are put into a vacuum degassing type kneader (manufactured by Inoue Seisakusho Co., Ltd), the mixture is stirred at 60° C. for 30 minutes, the pressure is reduced to further degas while warming up the mixture, so that the mixture is dried, and then classifying with a mesh of 105 μm is performed.

Pressurizing and Fixing Belt

Forming of Pressurizing and Fixing Belt (1)

Base Material

A cylindrical polyimide base material having a diameter of φ30 mm, a thickness of 60 μm, and a length of 400 mm is prepared and a surface thereof is roughened and then inserted into a stainless steel core.

Elastic Layer

A and B agents for a liquid silicone rubber (a silicone rubber raw material including an organopolysiloxane having a vinyl group and an organohydrogenpolysiloxane having a hydrogen atom (SiH group) bonded to a silicon atom, a product Name: DY 35-1310, Dow Corning Toray Co., Ltd.) are mixed in equal amounts, and then butyl acetate is added thereto so as to adjust the viscosity, thereby obtaining a coating liquid for forming an elastic layer. The surface of the polyimide base material is coated with a primer, and then is coated with the coating solution for forming an elastic layer according to a flow coating method. After drying a solvent, primary vulcanization is performed at 150° C. The thickness of the elastic layer is 200 μm.

Surface Layer

Next, a PFA tube (inner surface activation is treated) corresponding to a surface layer is expanded so as to adhere along the inner surface of a hollow metal tube (external mold) having an inner diameter slightly larger than the outer diameter of the core bar forming the base material and the elastic layer according to a vacuum-suction method.

Then, the core bar including the base material and the elastic layer is inserted into the inside of the external mold in which the PFA tube adheres to the inner surface. Note that, the surface of the elastic layer is coated with the primer. After that, the vacuum suction of the external mold is canceled so that the elastic layer is covered with the PFA tube. Further, the core bar is taken out together with the laminate and is subjected to secondary vulcanization by heating at 200° C. for four hours.

Next, after taking out the belt from the mold, both ends of the belt are cut and set as a pressurizing and fixing belt.

Image Forming Apparatus

Preparation of Image Forming Apparatus (1)

As an image forming apparatus, an image forming apparatus (product name: DOCUCENTRE COLOR 400CP manufactured by Fuji Xerox Co., Ltd) is prepared. Note that, the image forming apparatus is provided with a fixing device having a configuration illustrated in FIG. 1, as a fixing unit.

A developer including any one of the toners (1) to (4) and the toner (1C) indicated in the following Table 1 is accommodated in a developing device of the image forming apparatus.

In addition, the pressurizing and fixing belt (1) is installed as a pressurizing and fixing belt in the fixing device of the image forming apparatus. Note that, lubricating oil is applied to an interface between the pressurizing and fixing belt and the sliding member on the inner peripheral surface side.

In addition, as a heating roller (pressurizing rotator) facing the pressurizing and fixing belt, a cylindrical roller provided with an aluminum core, a rubbery elastic layer in the periphery of the core, and a surface layer formed of a fluorine resin in the periphery of the elastic layer is used.

Note that, a nip width in the fixing device of the image forming apparatus (1) is 8 mm.

Preparation of Image Forming Apparatus (C1) for Comparative Example

In the above-described image forming apparatus (1), a fixing member that forms a nip in the fixing device is changed to a fixing member (so-called a two-roller type fixing member) that forms a nip in which two rollers face each other so as to contact each other.

Specifically, the pressurizing and fixing belt and the member (a sliding member, a pressing member, or the like) which is provided on the inner periphery side in the image forming apparatus (1) are substituted with a pressurizing roller having an aluminum core and a surface layer formed of a fluorine resin in the periphery of the core. An image forming apparatus (C1) for Comparative Example which has the same configuration as that of the image forming apparatus (1) except for the above point is prepared.

Note that, a nip width in the fixing device of the image forming apparatus (C1) is 5.5 mm.

Evaluation

The paper transport speed (process speed) during image formation is set to 200 mm/sec, and a fixing temperature is set to 160° C.

Fixability

With A4 paper (C2 paper, manufactured by Fuji Xerox Co., Ltd), 500 images (solid images) having an image density of 100% are output.

Regarding the image output on the 500th paper, the paper is folded in half with the image surface facing inward, a pressure load of 10 g/cm$^2$ is applied to the fold for one minute, then the paper folded in half is opened and is lightly wiped to trace the folded part. At this time, a degree of the image deletion is visually evaluated based on the following criteria. The allowable range is equal to or greater than G2. The results are shown in Table 2.

Evaluation Criteria

G1: No image defect at all

G2: Streaks are lightly seen (width is equal to or less than 100 μm)

G3: Image defects are seen (width is greater than 100 μm and 500 or less)

G4: Image defects are severe (width is greater than 500 μm)

Releasability

In the evaluation test for the fixability, a solid image is output to the A4 paper while narrowing a margin part on the front side in the paper transport direction. Specifically, first, a solid image is output such that the width (the length in the paper transport direction) of the margin part on the front side in the paper transport direction is 5 mm. After that, the solid images are sequentially output while narrowing the margin part by 1 mm each time.

As the margin part on the front side of the paper transport direction narrows, winding around the fixing belt is likely to occur, and thus the evaluation of the releasability is performed based on the width (mm) of the margin part when the winding around the fixing belt at the time of fixing the solid image is confirmed, with reference to the following criteria. The allowable range is equal to or greater than G2. The results are shown in Table 2.

Evaluation Criteria

G1: Width of margin part is 2 mm or less

G2: Width of margin part is greater than 2 mm and 3 mm or less

G3: Width of margin part is greater than 3 mm

Evaluation of Low Temperature Fixability

The low temperature fixability evaluated with the image forming apparatus according to the following method.

In the image forming apparatus, the fixing device which may change the fixing temperature is used. In the image forming apparatus, the setting of the fixing temperature is changed at an interval of 5° C. within a range from 100° C. to 200° C. so as to fix an image, and the paper is folded in half with the fixed image surface side facing inward, a pressure load of 10 g/cm$^2$ is applied to the fold for one minute, then the paper folded in half is opened and is lightly wiped to trace the folded part. At this time, a degree of the image deletion is visually observed, and a temperature at which image peeling disappears is defined as the lowest fixing temperature.

Evaluation is performed based on the following evaluation criteria. The allowable range is 150° C. or less. The results are shown in Table 2.

Evaluation Criteria

G1: Case where the lowest fixing temperature is more than 120° C. and 140° C. or less G2: Case where the lowest fixing temperature is more than 140° C. and 150° C. or less G3: Case where the lowest fixing temperature is more than 150° C. and 160° C. or less G4: Case where the lowest fixing temperature is equal to or greater than 160° C.

TABLE 1

| | | Toner | | | | | | | Image forming apparatus | | |
|---|---|---|---|---|---|---|---|---|---|---|---|
| | | Types | Melting temperature of crystalline resin (A) [° C.] | Melting temperature of paraffin wax (B) [° C.] | Difference of melting temperature \|A-B\| [° C.] | Volume average particle diameter of toner particles [μm] | Shape factor SF1 of toner particles | Toluene-insoluble portion [% by weight] | Types | Fixing device | Nip width [mm] |
| Examples | 1 | (1) | 71 | 73 | 2 | 6.9 | 145 | 25 | (1) | Fixing belt | 8.0 |
| | 2 | (2) | 71 | 73 | 2 | 6.8 | 147 | 31 | (1) | Fixing belt | 8.0 |

TABLE 1-continued

| | | Toner | | | | | | | Image forming apparatus | | |
|---|---|---|---|---|---|---|---|---|---|---|---|
| | | Types | Melting temperature of crystalline resin (A) [° C.] | Melting temperature of paraffin wax (B) [° C.] | Difference of melting temperature \|A-B\| [° C.] | Volume average particle diameter of toner particles [μm] | Shape factor SF1 of toner particles | Toluene-insoluble portion [% by weight] | Types | Fixing device | Nip width [mm] |
| | 3 | (3) | 71 | 73 | 2 | 7.0 | 149 | 38 | (1) | Fixing belt | 8.0 |
| | 4 | (4) | 71 | 73 | 2 | 7.3 | 151 | 45 | (1) | Fixing belt | 8.0 |
| Comparative Examples | 1 | (C1) | 71 | 77 | 6 | 7.0 | 146 | 20 | (1) | Fixing belt | 8.0 |
| | 2 | (1) | 71 | 73 | 2 | 6.9 | 145 | 25 | (C1) | Two roller | 5.5 |
| | 3 | (2) | 71 | 73 | 2 | 6.8 | 157 | 31 | (C1) | Two roller | 5.5 |

TABLE 2

| | | Evaluation | | |
|---|---|---|---|---|
| | | Fix-ability | Re-leasa-bility | Low temperature fixability |
| Examples | 1 | G1 | G2 | G1 |
| | 2 | G1 | G1 | G2 |
| | 3 | G2 | G1 | G2 |
| | 4 | G2 | G1 | G2 |
| Comparative Examples | 1 | G2 | G4 | G3 |
| | 2 | G3 | G3 | G3 |
| | 3 | G4 | G2 | G4 |

From the above results, it is understood that Examples 1 to 4 in which the fixing device including the fixing belt, the pressurizing rotator that forms a nip by pressurizing the outer peripheral surface of the fixing belt, and the pressing member that presses the fixing belt in the direction of the pressurizing rotator is used, are excellent in the fixability of the toner image as compared with Comparative Examples 2 and 3 in which a two-roller type fixing device is used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a charging unit configured to charge a surface of the image holding member;

an electrostatic charge image forming unit configured to form an electrostatic charge image on a charged surface of the image holding member;

a developing unit that includes an electrostatic charge image developer containing an electrostatic charge image developing toner, and the developing unit being configured to develop the electrostatic charge image on the surface of the image holding member to form a toner image;

a transfer unit configured to transfer the toner image to a recording medium; and a fixing unit configured to fix the toner image onto the recording medium, wherein the fixing unit includes:

a fixing belt;

a pressurizing rotator configured to form a nip by pressurizing an outer peripheral surface of the fixing belt;

a sliding member configured to slide on an inner peripheral surface of the fixing belt in the nip in a contact manner, and a pressing member configured to press the fixing belt in the direction of the pressurizing rotator, and wherein the electrostatic charge image developing toner includes:

a binder resin containing an amorphous resin and a crystalline resin; and paraffin wax, wherein the toner has a volume average particle diameter of 6 ilm to 9 ilm, a shape factor SF1 of 140 or more, and a toluene-insoluble portion of greater than 30% by weight and not greater than 35% by weight;

the paraffin wax has a melting temperature of 60° C. to 80° C.; and an absolute value of a difference between a melting temperature of the crystalline resin and a melting temperature of the paraffin wax is 10° C. or less.

2. The image forming apparatus according to claim 1, wherein the melting temperature of the paraffin wax is from 65° C. to 78° C.

3. The image forming apparatus according to claim 1, wherein the melting temperature of the paraffin wax is from 65° C. to 75° C.

4. The image forming apparatus according to claim 1, wherein the absolute value of a difference between the melting temperature of the crystalline resin and the melting temperature of the paraffin wax is 5° C. or less.

5. The image forming apparatus according to claim 1, wherein the crystalline resin is a polyester resin.

6. The image forming apparatus according to claim 1, wherein a content of the crystalline resin is from 3% by weight to 20% by weight with respect to the toner.

7. The image forming apparatus according to claim 1, wherein a content of the crystalline resin is from 5% by weight to 15% by weight with respect to the toner.

8. The image forming apparatus according to claim 1, wherein a transport speed of the recording medium is from 90 mm/sec to 380 mm/sec.

9. The image forming apparatus according to claim 1, wherein a molecular weight distribution Mw/Mn of the amorphous resin is from 1.5 to 100, wherein Mw represents a weight average molecular weight of the amorphous resin, and wherein Mn represents a number average molecular weight of the amorphous resin.

10. The image forming apparatus according to claim 1, wherein a molecular weight distribution Mw/Mn of the amorphous resin is from 2 to 60, wherein Mw represents a weight average molecular weight of the amorphous resin, and wherein Mn represents a number average molecular weight of the amorphous resin.

* * * * *